US006199815B1

(12) United States Patent
Maier-Hunke

(10) Patent No.: US 6,199,815 B1
(45) Date of Patent: Mar. 13, 2001

(54) HOLDER FOR SWIVELLING PANELS OR THE LIKE

(75) Inventor: Horst-Werner Maier-Hunke, Iserlohn (DE)

(73) Assignee: "Durable" Hunke & Jochheim GmbH & Co. KG, Iserlohn (DE)

( * ) Notice: Subject to any disclaimer, the term of this patent is extended or adjusted under 35 U.S.C. 154(b) by 0 days.

(21) Appl. No.: 09/194,840

(22) PCT Filed: Jun. 2, 1997

(86) PCT No.: PCT/DE97/01155

§ 371 Date: Dec. 2, 1998

§ 102(e) Date: Dec. 2, 1998

(87) PCT Pub. No.: WO97/48087

PCT Pub. Date: Dec. 18, 1997

(30) Foreign Application Priority Data

Jun. 7, 1996 (DE) ..... 196 23 895

(51) Int. Cl.[7] ..... A47G 1/24

(52) U.S. Cl. ..... 248/454; 248/371; 248/441.1; 248/449; 40/532

(58) Field of Search ..... 248/454, 371, 248/397, 441.1, 447.1, 449; 40/492, 532, 536

(56) References Cited

U.S. PATENT DOCUMENTS

| | | | | |
|---|---|---|---|---|
| 3,514,883 | * | 6/1970 | Albright | 40/67 |
| 4,403,761 | * | 9/1983 | Jamar | 248/441 B |
| 4,669,694 | * | 6/1987 | Malick | 248/397 |
| 4,684,099 | * | 8/1987 | Krapf | 248/447.1 |
| 4,993,680 | * | 2/1991 | Gemmen et al. | 248/444.1 |
| 5,077,923 | * | 1/1992 | Rocola et al. | 40/510 |
| 5,222,611 | * | 6/1993 | Wood et al. | 211/94 |
| 5,778,577 | * | 7/1998 | Bailey | 40/450 |

* cited by examiner

*Primary Examiner*—Ramon O. Ramirez
*Assistant Examiner*—Walter Landry
(74) *Attorney, Agent, or Firm*—Mark P. Stone

(57) ABSTRACT

A holder capable of being fixed on a wall or support column carries swivelling panels which can be hung in the area of opposite front sides on pins formed from pairs of pins. The holder is provided in the area of a receiving cavity with clamping jaws which are suitable for mounting roller-shaped inserts useful for fastening the holder to support columns.

13 Claims, 3 Drawing Sheets

HOLDER FOR SWIVELLING PANELS OR THE LIKE

BACKGROUND OF THE INVENTION

The invention relates to a holder for flip boards and/or flip pockets and flip sheaths which are provided in the region of the upper and lower end of one of their edges with swivel bearings for pins arranged in each case in a row at the upper and lower edge of the holder.

Holders of the above type are widely used, inter alia, in offices, laboratories, workshops and supermarkets. They are easy to manipulate and permit the user rapid access to information contained in subject indexes, lists, standard sheets, price lists and similar documents. In order to be able to take account of different spatial features, the holders are regularly constructed such that they can be fastened both on walls and on holding columns. Holders are known in the case of which use is made for both abovementioned types of fastening of screws which are screwed either as wood screws into wall plugs, or as threaded screws into threaded bores of holding columns. The known holders are incapable of providing full satisfaction to the extent that when used in connection with holding columns they do not permit a change in position of the holder with respect to the column.

SUMMARY OF THE INVENTION

It is the object of the invention to provide a holder which with the aid of easily exchangeable accessories permits both the angular position of the holder to be set with respect to the longitudinal axis of a holding column, and the height of the holder to be set on the holding column, and which moreover is suitable in a known way for wall fastening. This object is achieved in the case of a holder of the generic type considered by virtue of the fact that the latter has a basic body with clamping jaws which are suitable for mounting a roller-shaped insert which can swivel about an axis running transverse to the longitudinal axis of the pins and is provided with a transverse bore for a holding column.

The holder according to the invention offers the advantage that, in conjunction with accessories formed by roller-shaped inserts, it can be more effectively adapted than known holders to spatial and application-specific features. The use of clamping jaws for holding the inserts permits not only rapid and convenient attachment as well as exchange of said inserts, but also, in the case of the use of the holder in conjunction with holding columns, permits the height and/or angular position of the holder with respect to the holding columns to be set in a fashion adapted to the respective situation.

BRIEF DESCRIPTION OF THE DRAWINGS

Further details and features of the invention follow from the subclaims and the following description of a particularly advantageous embodiment represented in the attached drawing, in which:

DESCRIPTION OF THE BEST MODES FOR CARRYING OUT THE INVENTION

Figure 1:
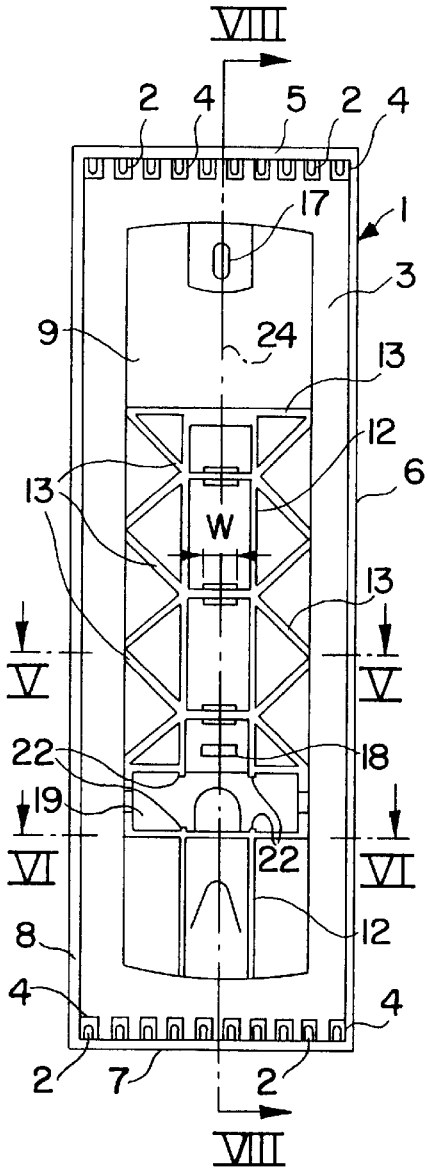
FIG. 1 is a front elevational view of a holder in accordance with the present invention.
Figure 2:
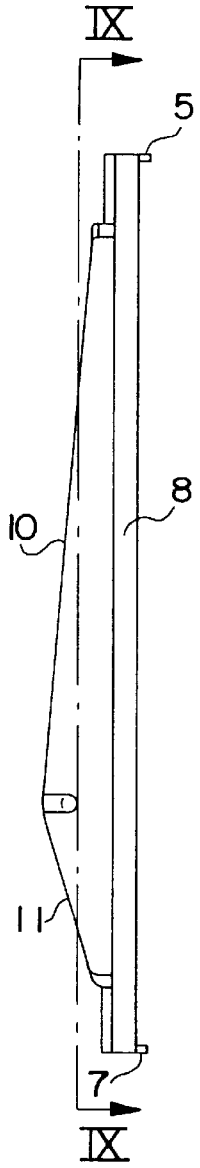
FIG. 2 is a side elevational view of the holder illustrated by FIG. 1.
Figure 5:
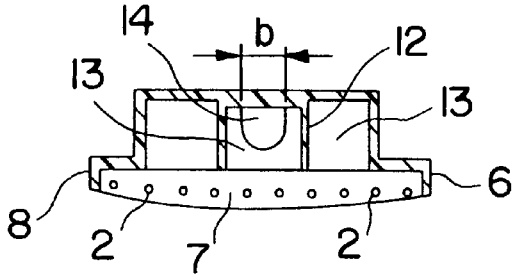
FIG. 5 shows a cross section of the holder in the region of the line V—V in FIG. 1.
Figure 7:
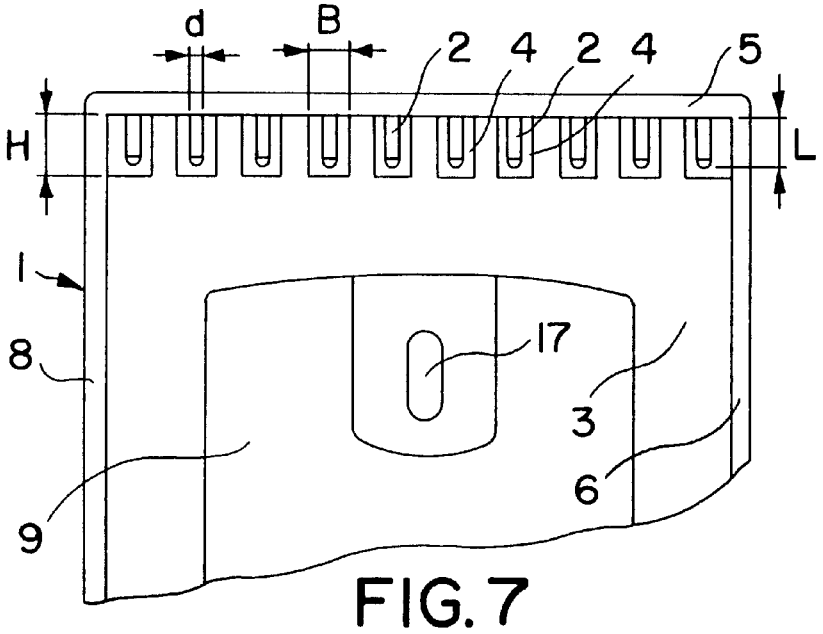
FIG. 7 shows the upper part of FIG. 1 on an enlarged scale.

In the figures, 1 denotes the basic body of a holder for known (and therefore not represented) swivel boards which are provided at mutually opposite ends of one of their edges with swivel bearings for rows of pins 2 arranged at the upper and lower edge of the holder. The holder shown has ten pairs of pins, and is therefore suitable for holding ten swivel boards which are constructed, for example, as scale-type boards. In order to permit cost-effective production of the holder, which is constructed as a plastic injection-moulded part, its rear wall 3 is provided in the region of the pins 2 with windows 4 which permit the insertion of injection moulds without splits. In order to lend the holder a satisfactory stability, it is of shell-shaped construction. It has end and side walls 5, 6, 7 and 8, constructed from a continuous web, and a central trough 9. In the region of the trough 9, the rear wall of the holder comprises two wall sections 10 and 11 which merge into one another in the lower third of the holder with the formation of an obtuse angle. Longitudinal struts 12 and transverse struts 13 in the region of the trough 9 make a considerable contribution to the stability of the holder. Four transverse struts 13 arranged in the centre of the trough 9 and running perpendicular to the longitudinal axis of the holder are provided with aligned plug-through openings 14 which permit a holding column to be pushed into the trough 9. Windows 15 are located in the wall section 10, in order also to be able to produce these cutouts cost-effectively. A guide channel 16 for a holding column is let into the wall section 11. As may be seen from FIGS. 1, 5 and 7, the height H of the window 4 is greater than the length L, and the width B of the window 4 is greater than the diameter d of the pins 2. By contrast, the width W of the window 15 is equal to the breadth b of the cutouts 14.

In order to be able to fasten the holder on a wall with the aid of screws, the wall section 10 is fitted with cutouts 17 and 18 which are formed by elongated holes and whose longitudinal axes are perpendicular to one another, in order to be able to adjust the position of the holder within certain limits.

As already stated, it is desired to be able to fasten the holder not only on a wall, but also on a holding column. In order to render the latter possible, in the deepest region of the trough 9 the holder has a receptacle 19, open towards the front side of the holder, for exchangeable inserts 20 and 21, as they are represented in FIGS. 9 and 11.

Figure 3:
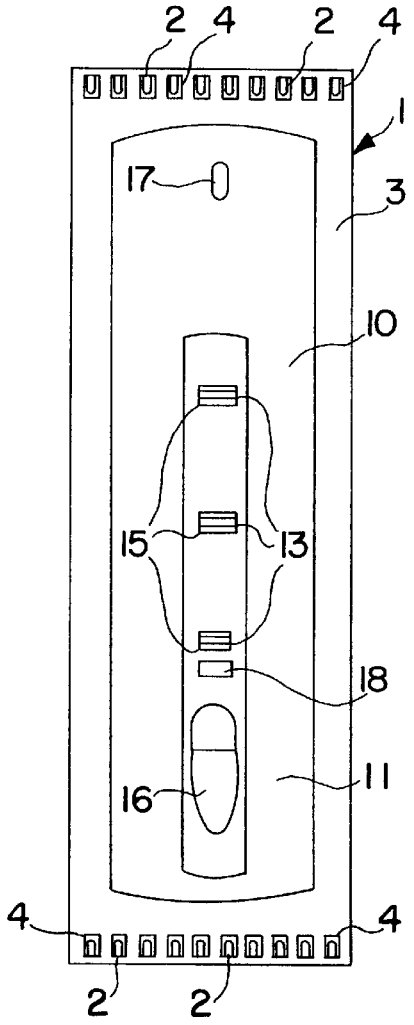
FIG. 3 is a rear elevational view of the holder illustrated by FIG. 1.
Figure 4:
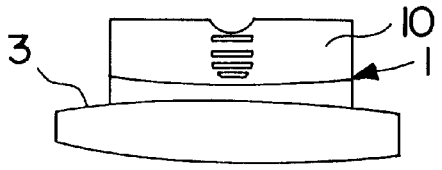
FIG. 4 is a top plan view of the holder illustrated by FIG. 1.
Figure 6:
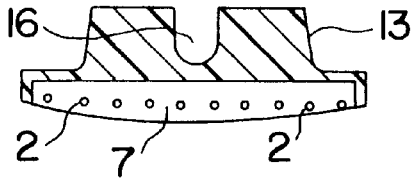
FIG. 6 shows a cross section of the holder in the region of the line VI—VI in FIG. 1.
Figure 8:
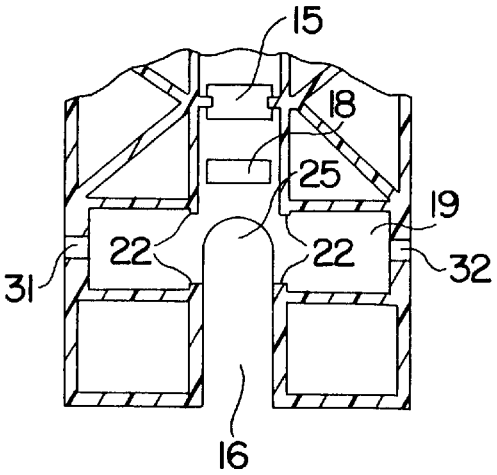
FIG. 8 shows a longitudinal section through a part of the holder in the region of line VIII—VIII in FIG. 1.
Figure 10:
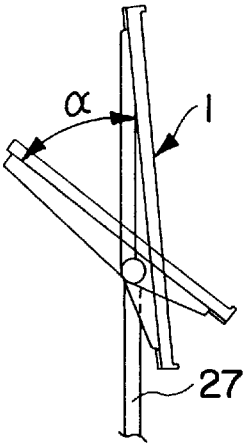
FIG. 10 shows the possibility, provided with the aid of the insert represented in FIG. 9, of changing the angular position of a holder plugged onto a holding column.

Clamping jaws 22, which are arranged in pairs and between which the roller-shaped inserts 20, 21 can be pressed, serve the purpose of fastening the inserts 20, 21 on the holder or in the receptacle 19. The spacing between the clamping jaws 22 of each pair of clamping jaws is tuned in this case to the outside diameter of the respective insert 20 or 21 in such a way that the latter can be swivelled into the receptacle 19 about its longitudinal axis 23 without being loosened. As may be seen from FIGS. 3, 6 and 8, the guide channel 16 let into the wall section 11 of the trough 9 opens into the receptacle 19 and is aligned with the plug-through openings 14 in the central transverse struts 13 arranged perpendicular to the longitudinal axis 24 of the holder. Adjoining the guide channel is a cutout 25 which extends in the base region of the receptacle 19 and is required in order as indicated in FIG. 10—to be able to swivel the holder about the longitudinal axis 23, and this at an angle $\alpha$ of at most 90°.

Figure 9:
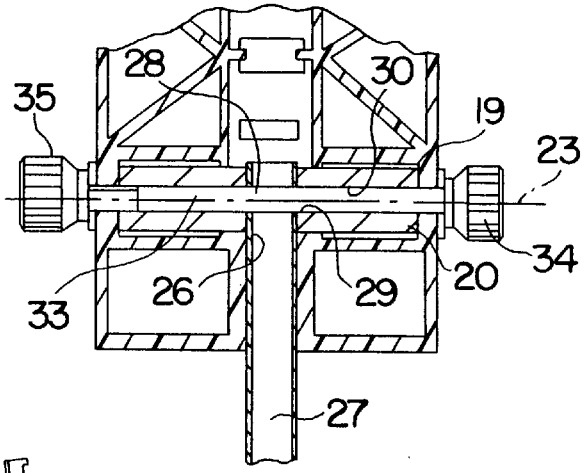
FIG. 9 shows a longitudinal section of the holder in the region of line IX—IX in FIG. 2 showing a first insert clamped in the receptacle illustrated by FIG. 8.

The insert 20 represented in FIG. 9 extends over the entire inside width of the receptacle 19, that is to say its end faces bear in the sliding fit against the inner surfaces, facing them, of the side walls of the receptacle 19. A holding column 27, which is formed by a tube and is provided in the region of its ends with transverse bores 28, 29, projects into a transverse bore 26 of the insert 20. The transverse bores 28, 29 are aligned with a longitudinal bore 30 of the insert 20. A threaded screw 33 with a knurled head 34 projects through the longitudinal bore 30 of the insert 20 and through bores 31, 32 in the side walls of the receptacle 19; a knurled nut 35 is screwed onto the end, averted from the head 34, of the threaded screw 33. It is possible by tightening the knurled nut 35 to press the side walls of the receptacle 19 firmly against the end faces of the insert 20 and to lock the latter in this way in a desired oblique position of the holder with respect to the holding column 27.

Figure 11:
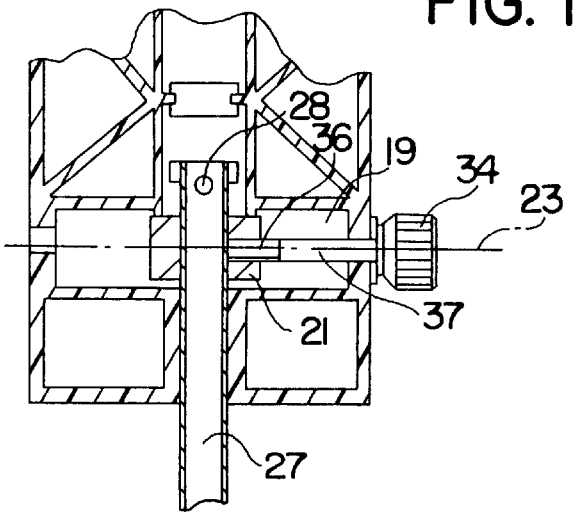
FIG. 11 shows the longitudinal section in accordance with FIG. 8 with a second insert clamped in the receptacle.
Figure 12:
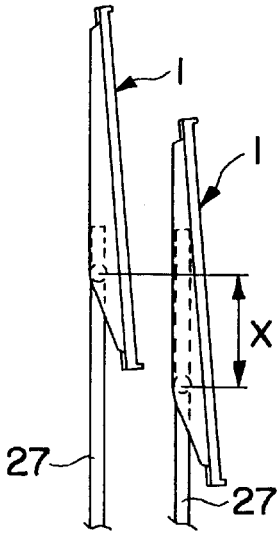
FIG. 12 shows the possibility, provided with the aid of the insert represented in FIG. 11, of setting the height of a holder plugged onto a holding column.

If there is no interest in the possibility of changing the angular position of the basic body 1 with respect to the longitudinal axis of the holding column 27, but is desired merely to render the basic body 1 capable of height adjustment by limited amounts in the direction of the longitudinal axis of the holding column 27, use is made of an insert 21 of the type represented in FIG. 11. The insert 21 has a threaded bore 36 into which the end of a threaded screw 37 is screwed which, in turn, has a knurled head 34. By pressing the free end of the threaded screw 37 against the circumference of the holding column 27, the position thereof is locked with respect to the insert 21 in a force-closed fashion. FIG. 12 shows two positions of the holder offset in height by the amount X on the holding column 27.

What is claimed is:

1. Holder for flip boards, or flip pockets, or flip sheaths; said boards, or pockets, or sheaths each defining at least one edge and being provided, in a region of an upper and lower end of said at least one edge, with a swivel bearing adapted to receive pins arranged in each case in a row in pairs at an upper and lower edge of the holder, characterized in that the holder has a basic body (1) with clamping jaws (22) which are suitable for mounting a roller-shaped insert (20, 21) which can swivel about an axis (23) running transverse to the longitudinal axis of the pins (2) and is provided with a transverse bore (26) for a holding column (27).

2. Holder according to claim 1, characterized in that the clamping jaws (22) are arranged on mutually opposite sides of a receptacle (19) open towards the front side of the holder.

3. Holder according to claim 2, characterized in that the basic body (1) has a rear wall (3) which is provided in a central region of the receptacle (19) with an insertion opening for the holding column (27) which can be plugged into the transverse bore (26) of the insert (20, 21).

4. Holder according to claim 3, characterized in that the insertion opening is arranged at an upper end of a guide channel (16), arranged in the rear wall (3) of the basic body (1), for the holding column (27).

5. Holder according to claim 3, characterized in that its sear wall (3) is provided with cutouts (17, 18) for screws serving to fasten the holder on a wall.

6. Holder according to claim 5, characterized in that the cutouts (17, 18) are formed by elongated holes whose longitudinal axes are mutually offset by 90°.

7. Holder according to claim 3, characterized in that its rear wall (3) has two wall sections (10, 11) which merge into one another with the formation of an obtuse angle.

8. Holder according to claim 7, characterized in that the two wall sections (10, 11) of the rear wall (3) merge into one another in the lower third of the holder.

9. Holder according to claim 2, characterized in that the basic body is provided with circumferential end and side walls (5, 6, 7, 8) and with a central trough (9) having the receptacle (19) for the roller-shaped insert (20, 21).

10. Holder according to claim 9, characterized in that the basic body (1), which is constructed as a plastic injection-moulded part, is provided in the region of its central trough (9) with longitudinal and transverse struts (12, 13) serving the purpose of reinforcement.

11. Holder according to claim 4, characterized in that the guide channel (16) is aligned with plug-through openings (14), for use in holding and guiding the holding column (27), in transverse struts (13).

12. Holder according to claim 5, characterized in that the side walls of the receptacle (19) are provided with aligned bores (31, 32) for a threaded screw (33) which can be plugged through an elongated bore (30) of the insert (20) and a transverse bore (28, 29) of the holding column (27) and serves to fix the angular position of the insert.

13. Holder according to claim 5, characterized in that at least one side wall of the receptacle (19) is provided with a bore (32) for a threaded screw (37) which can be screwed into a threaded bore (36) of the insert (21) and serves to lock in position a holding column (27) plugged into a transverse bore (26) of the insert (21).

* * * * *

UNITED STATES PATENT AND TRADEMARK OFFICE

CERTIFICATE OF CORRECTION

PATENT NO. : 6,199,815 B1
DATED : March 13, 2001
INVENTOR(S) : Horst-Werner, Maier-Hunke It is certified that error appears in the above-identified patent and that said Letters Patent is hereby corrected as shown below:

Claim 5,
Line 2, delete "sear", and substitute -- rear --.

Claim 12,
Line 1, delete "claim 5", and substitute -- claim 9 --.

Claim 13,
Line 1, delete "claim 5", and substitute -- claim 9 --.

Signed and Sealed this

Twenty-fifth Day of December, 2001

*Attest:*

*Attesting Officer*

JAMES E. ROGAN
*Director of the United States Patent and Trademark Office*